United States Patent [19]

Heim et al.

[11] 3,954,557

[45] May 4, 1976

[54] PERFORATED COMPACTOR BAR

[75] Inventors: Albert Heim, Haus Zypresse, Switzerland; Fausto Baroni, Verona, Italy

[73] Assignee: Clupak, Inc., New York, N.Y.

[22] Filed: Feb. 26, 1975

[21] Appl. No.: 552,981

[30] Foreign Application Priority Data

July 22, 1974 Italy ..... 52202/74

[52] U.S. Cl. ..... 162/272; 26/18.6; 162/361

[51] Int. Cl.[2] ..... D21H 5/06

[58] Field of Search ..... 162/272, 361, 199, 205, 162/206; 26/18.6

[56] References Cited

UNITED STATES PATENTS

| | | | |
|---|---|---|---|
| 3,011,545 | 12/1961 | Welsh et al. | 162/361 |
| 3,329,562 | 7/1967 | Schaefer | 162/361 |

*Primary Examiner*—S. Leon Bashore
*Assistant Examiner*—Richard V. Fisher

[57] ABSTRACT

Lubrication of a compacting resilient belt used in a web compacting system is facilitated by maintaining a constant depth pool of lubricating liquid between a fluid compactor bar and the inside surface of the belt on the belt approach side of the compactor bar. The compactor bar includes a liquid dam sidewall portion that is provided with liquid overflow weir openings so that the level of the surface of the pool can be automatically maintained at a predetermined height. The belt is used in conjunction with a drum to form a nip space between the outside surface of the belt and a peripheral sector of the drum, the nip space receiving the web to be compacted in the web running direction in a conventional manner, the outside surface of the belt being compressed against the drum by the compactor bar, which bears against the inside surface of the belt while the belt is driven through the nip space. The pool of lubricant is confined laterally by side plates or air jets directed inwardly towards the edges of the belt. Liquid lubricant is supplied to the pool area by a suitable supply means, such as spray nozzles, and excess lubricating liquid overflowing the weir openings is removed during operation of the apparatus. The system is particularly useful in providing lubrication between the belt and the compactor bar while minimizing the occurrence of leakage around the edges of the belt due to excess lubricant supplied to the pool area.

8 Claims, 4 Drawing Figures

FIG. 1
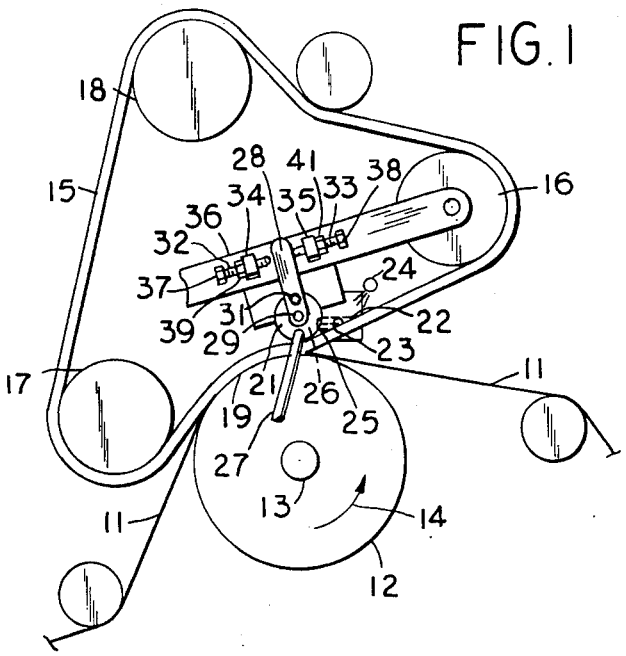
FIG. 2
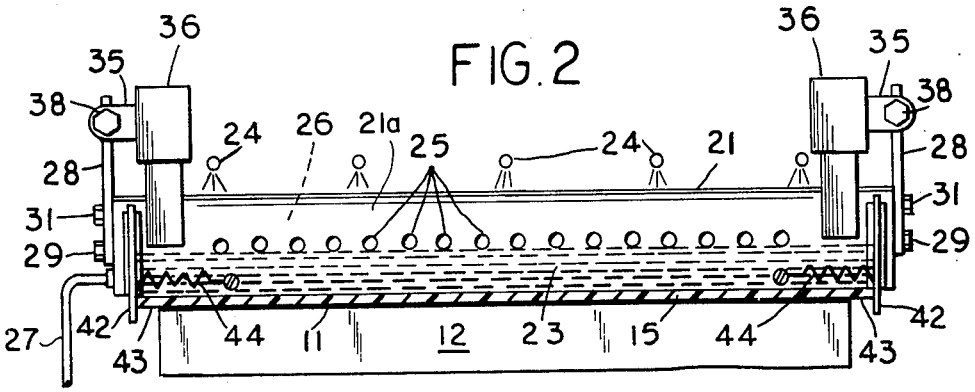
FIG. 4
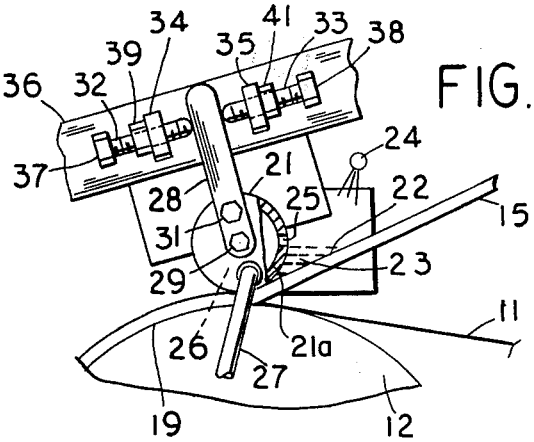
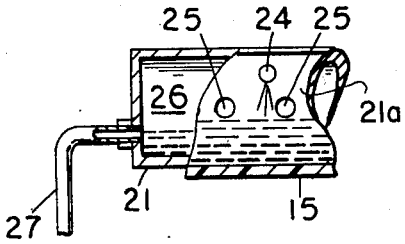
FIG. 3

PERFORATED COMPACTOR BAR

BACKGROUND OF INVENTION

This invention was conceived in connection with apparatus for the manufacture of uncreped stretchable paper as disclosed in Cluett U.S. Pat. No. 2,642,245; Welsh et al U.S. Pat. No. 3,011,545; and Schaefer U.S. Pat. No. 3,329,562, all owned by a common assignee of those patents and the present invention. Although utility of this invention is not limited to manufacture of uncreped stretchable paper, the invention is shown illustratively and is described herein as applied to that use.

Making an uncreped longitudinally stretchable paper web according to the teachings of these patents is accomplished by shrinking the paper web longitudinally by means of forces parallel to the surfaces of the web while the web is in a suitably moist condition and while the web is maintained under sufficient pressure normal to its surface to prevent creping or crinkling.

An accepted method of providing parallel forces to a web incapable of self support for the purpose of shrinking the web is to feed the web to a segment of travel between a rotating drum and a traveling endless resilient belt. The belt's outside surface is accelerated prior to the point of web feed, and then the belt's outside surface is caused to decelerate after the point of web feed. The deceleration of the belt's outside surface while it is in contact with the web causes the parallel forces on the web which compact or shrink the web.

More specifically, as described in U.S. Pat. Nos. 2,642,245 and 3,011,545, the acceleration and subsequent deceleration of the outside surface of the resilient belt may be effected by feeding the belt along its travel to a restricted nip space formed by and between a loaded compactor bar and a rotating smooth faced drum. As the resilient belt is substantially noncompressible, it accelerates prior to the nip space in order to pass through the restriction of the nip space and it decelerates after it passes through the nip space. The web, which is fed into the nip space and into contact with the outside surface of the traveling belt after the belt has been accelerated, is shrunk by the parallel forces transmitted to it as the outside surface of the belt decelerates and while the web is pressed against the drum. The shrinkage of the web is controlled by varying the restriction of the nip space which causes change in surface velocity of the outside surface of the traveling belt.

In commercial practice, even though the compactor may be a rotating type, there tends to be a scuffing effect on the inside surface of the belt if the belt runs dry. The use of a lubricant of water or other liquid eliminates this scuffing and it has been observed that the compactor bar even stops rotating when lubricant is present. With a non-rotating bar, which is more commonly used, the need for a lubricant is essential but presents the following situation. If the amount of lubricating liquid supplied, such as by spraying on the belt, is carefully adjusted so that it equals the loss consumed during lubrication and by evaporation, etc., then the inner belt surface is adequately lubricated in the nip area and there is no surface liquid available to leak out of the nip at the ends of the belt to cause damage to the paper web at those points. It can be readily seen that such a nice adjustment is different in practice, however and usually to avoid the nip running dry, an excess of water at the belt approach side of the nip is provided. This further requires that excess water in the puddle be removed, and such removal has been achieved in the past by the fitting of edge pans to the edge of a belt such that the excess water can flow into the pan and be allowed to run away. Because these edge pans have from the very beginning proven to be difficult to design with an effective seal, they have never been very popular. In practice, they leak badly, causing trouble to the edges of the paper web and, from time to time, they damage the rubber belt. To obviate this, many users of equipment have removed these edge pans and have fitted compressed air pipes so that jets of air can be directed at the edges of the belt where the water would normally leak away and this air stream creates an air dam which restricts the leakage of water at this point. However, this is only effective if the pool formed by the excess water at the belt approach side of the compactor bar remains at a constant height. For the reasons given beforehand, this state of affairs cannot usually be kept and the pool frequently rises to a level whereby it overcomes the air resistance of the air dam and leaks around the belt edges as before. Thus, the main contribution of the new compactor bar of this invention is to maintain a constant but carefully controlled pool height so that, once an air dam or edge pans are adjusted to contain the water at the edges of the belt, the state of equilibrium will not change.

STATEMENT OF INVENTION

Problems of the prior art are coped with here in a useful, novel, unobvious and particularly facile way. Lubricating liquid is introduced conventionally onto the inside surface of the belt whereby a pool of the liquid is maintained between the compactor bar and the inside surface of the belt as the belt approaches the compactor bar. The compactor bar includes a sidewall portion constituting a liquid dam on the belt approach side of the compactor bar. At least one weir opening is provided in the liquid dam of the compactor bar to enable excess liquid to overflow via the weir to maintain a desired level of the pool of lubricating liquid. Means are provided for removing such excess liquid overflow. The compactor bar is movable for adjusting the weir height. The pool is confined laterally by either air jets or by plates biased into contact with sides of the belt.

Accordingly one object of this invention is to provide more reliable lubrication to the belt.

Another object of this invention is to provide better control of lubrication to the belt.

Still another object of this inventon is to reduce wear of the belt.

Still another object of this invention is to avoid outleakage of the lubricant onto the paper or drum with consequent wrinkling or tearing of the web, poor compaction and/or pucker spots on the web.

Still another object of this invention is to improve working conditions in making an uncreped longitudinally stretchable web.

DESCRIPTION OF DRAWING

The foregoing and other objects, features and advantages of this invention will appear more fully from a detailed description of a preferred embodiment thereof and from claims, both of which follow, all taken in conjunction with an accompanying drawing wherein like numerals indicate like parts throughout and wherein:

FIG. 1 is a schematic side elevation view of a compacting apparatus according to this invention;

FIG. 2 is an end view showing the compactor bar, the pool of lubricating liquid and confining means therefor;

FIG. 3 is an enlarged detail showing removal of excess lubricating liquid via the weir openings, the interior of the compactor bar and suitable discharge means; and FIG. 4 is a partly broken away side elevation view to an enlarged scale showing means for adjusting the height of the weir openings in the compactor bar.

DESCRIPTION OF A PREFERRED EMBODIMENT

A web 11 is shown in FIG. 1 to be supplied from some preceding operation. The compacting apparatus includes a drum 12 (usually heated) of substantial diameter. Drum 12 is of sturdy construction and is mounted on a shaft 13 which, preferably is driven rotatably by a suitable means (indicated as an arrow 14). A thick belt 15, made of a resilient elastomeric material (such as rubber), is mounted on three rollers 16, 17 and 18 which are arranged to tension the belt 15. The belt 15 has a run which travels on a segment 19 of the drum 12. The belt 15 is driven by the drum 12. Rotary parts thus far described all are mounted in rigid side frame members (not shown) which are disposed outside lateral bounds of the web 11 and the belt 15.

As shown in FIG. 2, a compactor bar 21 extends across the machine through the full length of the drum 12 and the compactor bar 21 is supported at its end. The compactor bar 21 preferably is a thick walled but hollow cylinder preferably of a smooth, corrosion resistant steel alloy and is of substantial strength and rigidity. The compactor bar 21 is loaded by well known means and is disposed as shown best in FIG. 4 to engage an inside surface 22 of the belt 15 and to press the belt 15 radially against the drum 12 to form a uniform nip space for the web 11. This is the nip space whereby compacting of the web takes place.

As has been pointed out, improved lubrication of the belt 15 is provided by maintaining a pool 23 of a lubricating liquid between the compactor bar 21 and the inside surface 22 of the belt 15 as shown best in FIG. 4. The lubricating liquid which may be water, a mixture of glycerine and water, or a silicone release agent etc. is introduced from a suitable source (not shown) via some nozzles 24. As shown best in FIG. 3, level of the pool 23 of the lubricating liquid is set by height of weir openings 25 provided in the compactor bar 21, which weir openings 25 cmmunicate in flow series with an interior space 26 in the compactor bar 21, and subsequently via line 27 for convenient discharge of excess of the lubricating liquid. The weir openings 25 may be round as shown in FIGS. 2 and 3, slotted or of any other suitable configuration. The weir openings 25 are provided in a wall surface 21*a* of the compactor bar 21, which wall 21*a* constitutes a liquid dam portion of the compactor bar, on the belt approach side of the compactor bar.

Adjustment of height of the weir openings 25 is accomplished in the embodiment illustrated as shown best in FIGS. 2 and 4, by rotating the compactor bar 21 by means of a crank 28 connected to the compactor bar 21 by means of screws 29 and 31. The crank 28 can be rotated using opposed screws 32 and 33 which pass threadably through abutments 34 and 35 respectively both connected on either side rigidly to their housing member 36. The screws 32 and 33 are provided with heads 37 and 38 respectively and have lock nuts 39 and 41 respectively.

Lateral confinements of the pool 23 of lubricating liquid is achieved by plates 42 each depending from the compactor bar 21 and each being maintained in contact with a side 43 of the belt 15 by means of a spring 44. (See FIG. 2).

It will be understood by those familiar with compacting webs that various departures may be made from the foregoing detailed description of a preferred embodiment of the invention, (for example confining means at the end of the nip bar such as air jets could be used) without departing from a main theme of invention set forth in claims which follow.

We claim:

1. In a web treating apparatus comprising a cylindrical drum; a compactor bar having a sidewall includng a smooth curved surface portion located adjacent a peripheral, sector of the drum and extending generally parallel to the sector; a relatively thick endless belt of an elastomeric material arranged to pass between the peripheral sector of the drum and the curved surface of the compactor bar, with the outer surface of the belt contiguous to the drum and the inner surface of the belt contiguous to the bar; means for driving the belt between the compactor bar and the peripheral drum sector; means for enabling the compactor bar to press the belt against the drum in compressed condition so that a nip space between the outside surface of the belt and the peripheral sector of the drum is established, the outer belt surface stretching and subsequently contracting to its normal length as it passes through and beyond the nip space during operation of the apparatus; means for continuously supplying a liquid lubricant on the inside surface of the belt in advance of the compactor bar; and means for feeding a contractable web to be treated through the nip space between the belt's outer surface and the drum, whereby the web initially adheres to the stretched outside surface of the belt passing through the nip space and, as the outside surface of the belt contracts in passing beyond the nip space, the web is compacted while it is still against the drum; the improvement comprising, said compactor bar having a liquid dam sidewall portion connected to the smooth curved surface portion and being located on the belt approach side of the compactor bar, the liquid dam portion extending along the length of the compactor bar; liquid confining means at each edge of the belt at least adjacent the belt approach side of the compactor bar for preventing liquid flow beyond the belt edges in the vicinity of the liquid dam sidewall portion of the compactor bar; the compactor bar having liquid receiving means associated therewith and being provided with at least one weir opening in that portion of its sidewall constituting the liquid dam, the weir opening being in communication with said liquid receiving means and being spaced a predetermined distance from the inside surface of the belt on the belt approach side of the compactor bar, whereby during operation of the apparatus and supply of liquid lubricant to the inside surface of the belt in advance of the compactor bar, a pool of lubricant may be established and maintained at the liquid dam portion of the compactor bar on the inside surface of the belt, the depth of the pool being determined by the distance of said weir opening from said inside surface of the belt on the belt approach side of the compactor bar, the surface of the pool being maintained at a constant level by the overflow of excess liquid through the weir opening into the liquid receiving means associated with the compactor bar.

2. The apparatus recited in claim 1 further wherein the compactor bar is movable to permit adjustment of the distance of weir opening from the inside surface of the belt on the belt approach side of the compactor bar.

3. The apparatus recited in claim 1 wherein the compactor bar is a generally cylindrical member mounted for limited rotation about its axis, the said liquid dam sidewall portion of said compactor bar comprising a portion of the sidewall of the cylindrical member on the belt advance side thereof, and means for rotating the cylindrical member about its axis to adjust the distance of the weir opening from the inside surface of the belt on the belt approach side of the compactor bar to thereby adjust the depth of the pool of lubricating liquid.

4. The apparatus recited in claim 1, further wherein the compactor bar is provided with a plurality of the weir openings spaced across its length, all the openings being spaced substantially an equal distance from the inside surface of the belt.

5. The apparatus recited in claim 1, further wherein the confining means comprises a pair of plates each connected to the compactor bar and each being maintained in contact with an opposite edge of the belt.

6. The apparatus recited in claim 5, further including a spring connected between each of the plates and the compactor bar to urge each of the plates into contact with its respective edge of the belt.

7. The apparatus recited in claim 1, wherein the compactor bar is a hollow, generally cylindrical member, and wherein the interior thereof constitutes said liquid receiving means; and furthermore including excess liquid lubricant removal means for removing excess liquid from the interior of the compactor bar.

8. The apparatus of claim 1, further wherein the cylindrical drum is mounted for rotation about its axis; means for driving the drum, said drum driving means further comprising said means for driving the belt between the compactor bar and the peripheral drum sector.

* * * * *